US005488941A

United States Patent [19]

Springstead

[11] Patent Number: 5,488,941

[45] Date of Patent: Feb. 6, 1996

[54] BRUSH GUARD FOR HUNTING BOWS

[76] Inventor: Louis H. Springstead, 710 Barclay Hills Dr., Oregon City, Oreg. 97045

[21] Appl. No.: 237,704

[22] Filed: May 3, 1994

[51] Int. Cl.[6] ..... F41B 5/14

[52] U.S. Cl. ..... 124/86; 124/25.7

[58] Field of Search ..... 124/1, 23.1, 25.5, 124/25.6, 25.7, 86, 88

[56] References Cited

U.S. PATENT DOCUMENTS

| | | | |
|---|---|---|---|
| 2,968,300 | 1/1961 | Allen | 124/88 X |
| 3,258,000 | 6/1966 | Kolpacki | 124/88 X |
| 3,465,928 | 9/1969 | Osterholm | 124/25.7 X |
| 3,591,062 | 7/1971 | Karbo | 124/25.7 X |
| 3,716,174 | 2/1973 | Ehlert | 124/25.7 X |
| 4,020,984 | 5/1977 | Morris | 124/88 |
| 4,377,152 | 3/1983 | Saunders | 124/88 |
| 4,817,579 | 4/1989 | Mathias | 124/86 X |
| 4,876,817 | 10/1989 | Hill | 124/86 X |
| 4,979,488 | 12/1990 | Fenton | 124/25.6 |
| 5,137,008 | 8/1992 | Taylor | 124/88 |

*Primary Examiner*—John A. Ricci
*Attorney, Agent, or Firm*—Henderson & Sturm

[57] ABSTRACT

A brush guard (10) for preventing brush (75) from becoming wedged between the upper limb (101) of a bow (100) and a quiver (200) mounted on the bow (100); wherein, the brush guard (10) includes an elongated brush guard arm member (50) releasably attached to the quiver cap (204) on one end (51) and disposed proximate to the upper limb (101) on the other end (52).

19 Claims, 1 Drawing Sheet

BRUSH GUARD FOR HUNTING BOWS

TECHNICAL FIELD

This present invention relates to the field of archery accessories in general, and in particular, to a device that prevents brush and other obstructions from becoming lodged between the quiver and limbs of a bow under normal hunting conditions.

BACKGROUND ART

As can be seen by reference to the following U.S. Pat. Nos. 5,137,008; 4,979,488; 4,817,579; and 4,377,152; the prior art is replete with myriad and diverse archery accessories employed to improve the performance of a bow.

While all of the aforementioned prior art constructions are more than adequate for the basic purpose and function for which they have been specifically designed, these patented devices do nothing to solve a problem that has vixed bow hunters since the advent of modern bow hunting several decades ago.

As any avid or even casual bow hunter is all too painfully aware, the use of bow mounted quivers produces both advantages and disadvantages to the bower, with the primary disadvantage being the almost uncanny ability of brush, twigs, weeds and branches to become lodged between the quiver and the bow per se.

It should further be noted that this condition is not only aggravating to a bow hunter on foot, but is potentially very dangerous to a bow hunter on horseback since more than one bow hunter has been unceremoniously dismounted from a horse by brush being tightly wedged between the bow and the quiver.

As a consequence of the foregoing situation, there has existed a longstanding need for a brush guard for hunting bows that will prevent any obstructions from becoming lodged between the bow and the quiver, and the provision of such a construction is a stated objective of the present invention.

DISCLOSURE OF THE INVENTION

Briefly stated, the brush guard that forms the basis of the present invention comprises an elongated contoured brush guard arm member having a lower end adapted to be secured to the cap portion of a conventional bow mounted quiver and a bifurcated upper end dimensioned to receive the upper limb of a hunting bow.

In addition, the upper end of the brush guard arm member is further provided with a removable sleeve element which is adapted to cooperate with the forked end of the brush guard arm member to effectively encircle the upper limb of the bow, and a generally resilient flap element that is secured to the brush guard arm member and bears against one side of the upper limb of the bow in its operative disposition.

As will be explained in greater detail further on in the specification, the brush guard of this invention makes it virtually impossible for any obstruction to become lodged between the bow and the quiver, while still permitting the limbs of the bow to flex in an unimpeded fashion when the bow is drawn back prior to an arrow being released.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
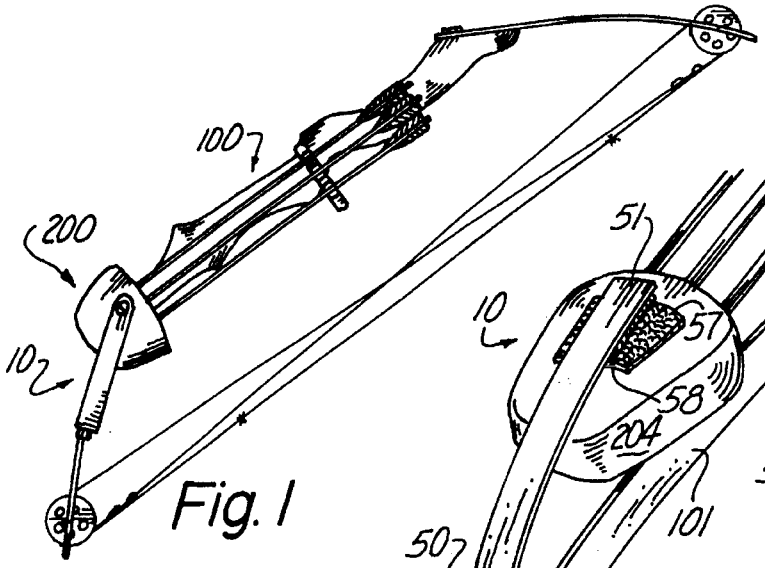
FIG. 1 is a perspective view of the brush guard of this invention operatively deployed on a bow equipped with a bow mounted quiver.

As can be seen by reference to the drawings, and in particular to FIG. 1, the brush guard that forms the basis of the present invention is designated generally by the reference numeral (10).

Prior to embarking on a detailed description of the brush guard (10) per se, it would first be advisable to briefly discuss the two major components that the brush guard (10) was specifically designed to cooperate with to wit a conventional bow (100) and bow mounted quiver (200).

Figure 5:
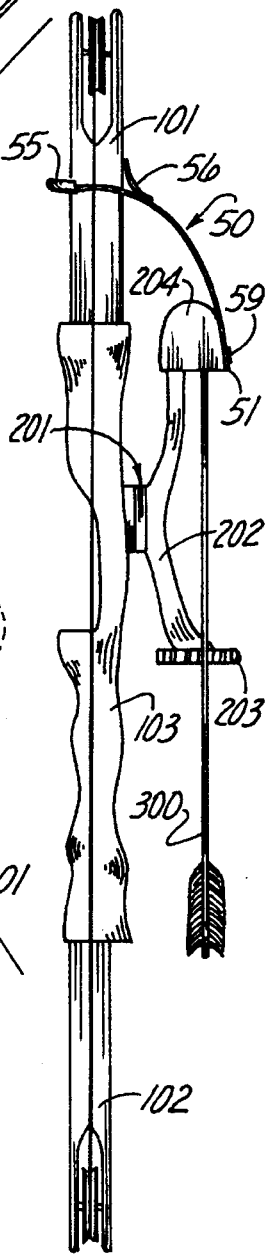
FIG. 5 is a rear elevation view of the brush guard operatively deployed on a conventional bow and quiver arrangement.

As can best be seen by reference to FIGS. 1 and 5, the conventional bow (100) includes an upper limb member (101) connected to a lower limb member (102) via a handle or riser section (103) which is provided with one or more tapped holes (not shown) for accepting a variety of archery accessories, including a bow mounted quiver (200).

The quiver (200) includes a mounting bracket (201) connected to the quiver brace arm (202); wherein, the lower portion of the quiver brace arm (202) is provided with an arrow clip element (203) for releasably engaging the shaft portion of one or more hunting arrows (300), and wherein the upper portion of the quiver brace arm (202) is provided with a quiver cap (204) that provides a cushioned receptacle for the sharpened hunting heads (301) installed on the arrows (300).

Figure 2:
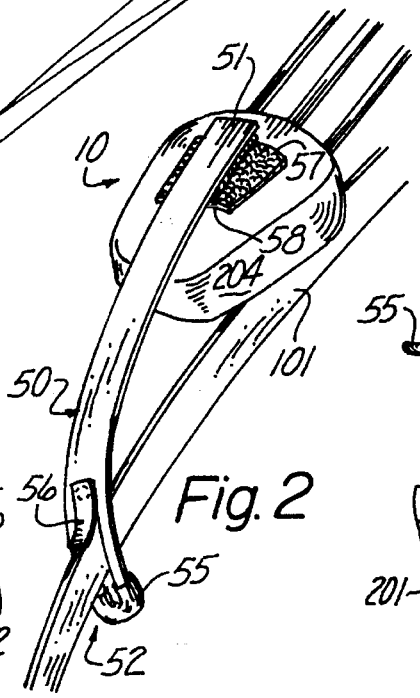
FIG. 2 is an isolated detail view of one of the preferred means for securing the brush guard to the quiver.
Figure 3:
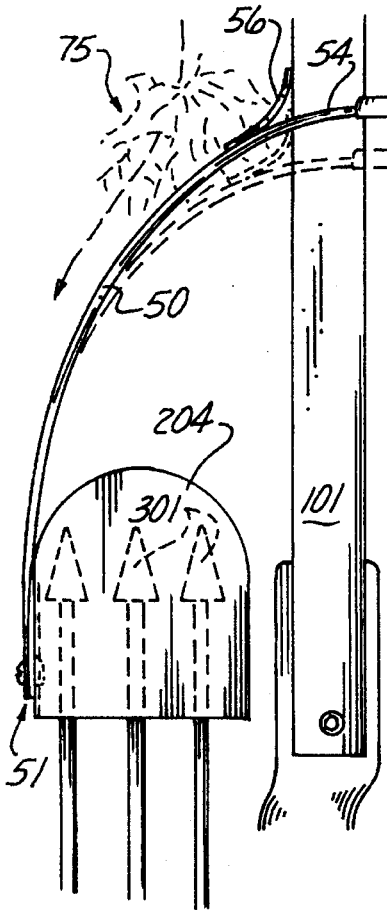
FIG. 3 is an isolated detailed view of another of the preferred means for securing the brush guard to the quiver.
Figure 4:
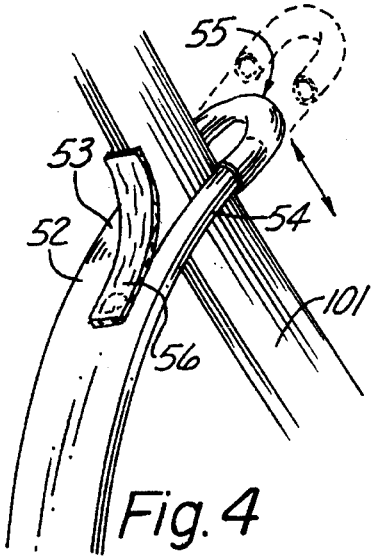
FIG. 4 is an isolated detailed view of the bifurcated upper end of the brush guard arm member.

Turning now to FIGS. 2 through 4, it can be seen that the brush guard (10) comprises a generally elongated and curved brush guard arm member (50) having a lower end (51) secured to the exterior of the quiver cap (204) and having a bifurcated upper end (52) which at least partially surrounds the upper limb (101) of the bow (100).

As can best be seen by reference to FIG. 4, the forked fingers (53)(54) on the bifurcated upper end (52) of the brush guard arm member (50) are spaced apart a sufficient distance from one another to allow the upper limb (101) of the bow to be flexed in the normal fashion as the bow is drawn.

In addition, the forked fingers (53)(54) are further provided with an optional sleeve element (55) that releasably engages the free ends or tips of the forked fingers (53) (54) to completely encircle the upper limb (101) of the bow (100) to prevent the forked fingers (53)(54) from becoming snagged on the brush or the like.

Still referring to FIG. 4, it can be seen that the upper end (52) of the brush guard (10) is further provided with an elongated generally resilient flap element (56) secured on one end to the upper end (52) of the brush guard (10) proximate to the juncture of the forked fingers (53)(54), wherein the other end of the resilient flap element (56) at least partially overlies the juncture of the forked fingers (53)(54) for reasons that will be explained presently.

Turning now to FIG. 2, it can be seen that in one form of the preferred embodiment, the lower portion (51) of the brush guard arm member (50) is secured to the quiver cap (204) via cooperating hook and loop fasteners, wherein exterior surface of the quiver cap (204) is provided with a large patch (57) of one hook and loop component, and the downwardly facing surface of the lower portion (51) of the brush guard arm member is provided with an elongated strip (58) of the other hook and loop component.

In this particular version of the preferred embodiment, no permanent alteration has to be made to the quiver cap (204) and the proper orientation of the brush guard (10) relative to both the upper bow limb (101) and the quiver cap (204) may be quickly and easily accomplished. It should further be noted that hook and loop fasteners are extremely resistant to lateral displacement relative to one another, and as a consequence, the brush guard (10) should remain in place, except under the most extreme conditions.

In an alternate version of the preferred embodiment depicted in FIG. 5, the lower end (51) of the brush guard arm member (50) is secured to the quiver cap (204) via more conventional fasteners (59) such as screws or the like for a more permanent attachment of the quiver cap (204).

As can best be seen by reference to FIG. 3, once the brush guard arm member (50) has been properly installed on the quiver cap (204) when the user carries their bow through brushy areas, the brush or other obstruction (75) will contact the curved upper end (52) of the arm member (50) deflecting the obstruction (75) away from the upper limb (101) of the bow (100) and around and past the quiver cap (204), so that the obstruction (75) cannot become lodged between the bow (100) and the quiver (200).

In addition, when the obstruction (75) forcibly depresses the upper end (52) of the arm member (50) downwardly as depicted in phantom in FIG. 3, the resilient flap element (56) prevents any portion of the obstruction (75) from being pinched between the juncture of the forked fingers (53)(54) and the upper limb (101) of the bow (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A brush guard for use with a bow having an upper limb member and further equipped with a quiver having a quiver cap; wherein the brush guard comprises:

an elongated generally flexible brush guard arm member having an upper end and a lower end; wherein, the lower end is operatively attached to said quiver cap, and the upper end projects upwardly and is disposed proximate to said upper limb member for deflecting brush away from said upper limb member.

2. The brush guard as in claim 1; wherein, said upper end of the brush guard arm member at least partially surrounds said upper limb member.

3. The brush guard as in claim 2; wherein, the upper end of the brush guard arm member is provided with means for completely surrounding said upper limb member.

4. The brush guard as in claim 1; wherein, the upper end of the brush guard arm member is provided with a pair of forked fingers that at least partially surround said upper limb member.

5. The brush guard as in claim 4; wherein, the upper end of the brush guard arm member is further provided with a sleeve element that releasably engages the ends of said forked fingers to completely surround said upper limb member apparatus.

6. The brush guard as in claim 1; wherein, the upper end of the brush guard arm member is further provided with a flap element having one end which is secured to the upper end of the brush guard arm member and having another end which projects outwardly in the direction of said upper limb member.

7. The brush guard as in claim 1; wherein, the lower end of the brush guard arm member is releasably secured to said quiver cap.

8. The brush guard as in claim 1; wherein, the lower end of the brush guard arm member is adjustably secured to said quiver cap.

9. In the combination of a bow having an upper limb and a quiver mounted on the bow and having a quiver cap, an improvement comprising:

an elongated generally arcuate flexible brush guard means operatively disposed between said upper limb and said quiver cap for preventing objects from becoming wedged between said upper limb and said quiver cap.

10. The improvement as in claim 9; wherein, said means is physically attached to only one of said bow and said quiver.

11. The improvement as in claim 10; wherein, the said means is disposed proximate to the other one of said bow and said quiver.

12. A brush guard for use with a bow having an upper limb member and further equipped with a quiver having a quiver cap; wherein the brush guard comprises:

an elongated generally arcuate brush guard arm member having an upper end and a lower end; wherein, the lower end is operatively attached to said quiver cap, and the upper end is disposed proximate to said upper limb member for deflecting brush away from said upper limb member.

13. The brush guard as in claim 12; wherein, said upper end of the brush guard arm member at least partially surrounds said upper limb member.

14. The brush guard as in claim 13; wherein, the upper end of the brush guard arm member is provided with means for completely surrounding said upper limb member.

15. The brush guard as in claim 12; wherein, the upper end of the brush guard arm is provided with a pair of forked fingers that at least partially surround said upper limb member.

16. The brush guard as in claim 15; wherein, the upper end of the brush guard arm member is further provided with a sleeve element that releasably engages the ends of said forked fingers to completely surround said upper limb member apparatus.

17. The brush guard as in claim 12; wherein, the upper end of the brush guard arm member is further provided with a flap element having one end which is secured to the upper end of the brush guard arm member and having another end which projects outwardly in the direction of said upper limb member.

18. The brush guard as in claim 12; wherein, the lower end of the brush guard arm member is releasably secured to said quiver cap.

19. The brush guard as in claim 12; wherein, the lower end of the brush guard arm member is adjustably secured to said quiver cap.

* * * * *